United States Patent [19]

Bond et al.

[11] 4,444,340

[45] Apr. 24, 1984

[54] SELF-SEALING DISPENSING VALVE AND SPOUT ASSEMBLY

[75] Inventors: Curtis J. Bond, Marion; John G. Ulm, Upper Sandusky, both of Ohio

[73] Assignee: Liqui-Box Corporation, Worthington, Ohio

[21] Appl. No.: 382,485

[22] Filed: May 27, 1982

[51] Int. Cl.[3] ..... B65D 47/08

[52] U.S. Cl. ..... 222/498; 222/517

[58] Field of Search ..... 222/498, 490, 511, 513, 222/518, 545, 562, 563, 499, 517

[56] References Cited

U.S. PATENT DOCUMENTS

| | | | |
|---|---|---|---|
| 3,400,866 | 9/1968 | Fattori | 222/511 |
| 3,443,728 | 5/1969 | Scholle | 222/511 |
| 3,972,452 | 8/1976 | Welsh | 222/501 |
| 4,211,348 | 7/1980 | Scholle | 222/498 |

*Primary Examiner*—Stanley H. Tollberg
*Attorney, Agent, or Firm*—William V. Miller

[57] ABSTRACT

A removeable and replaceable self-sealing valve formed of resiliently flexible plastic which has inner and outer concentric walls spaced to provide an axially inwardly-opening socket for receiving the outer end of a semi-rigid plastic spout carried by a flexible plastic bag. The spout has one or more inner anular sealing ribs formed therein at a location spaced axially-inwardly from its lip and the inner wall normally resiliently engages this seal. A toggle lever is connected to the inner wall to flex it so that a portion thereof is flexed away from the sealing rib to open a dispensing passage to an outlet in the outer wall beyond the spout lip. A removable seal retainer insert holds the inner wall in sealed position until the valve is to be used.

8 Claims, 11 Drawing Figures

FIG. 3
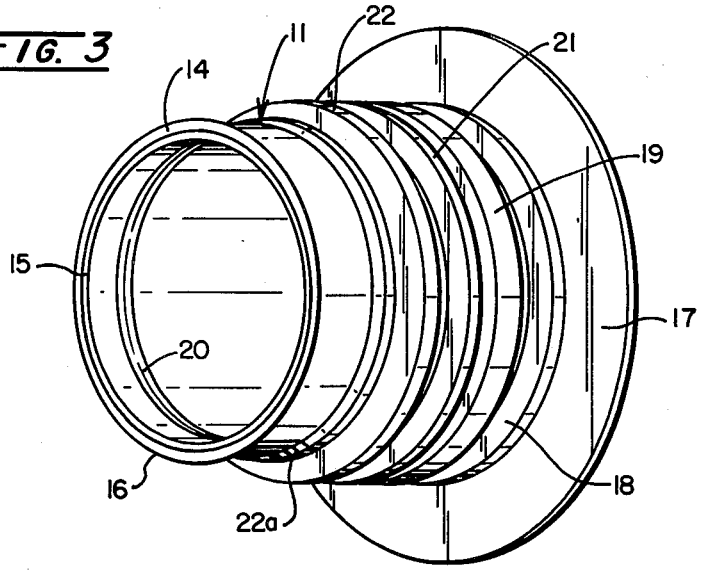
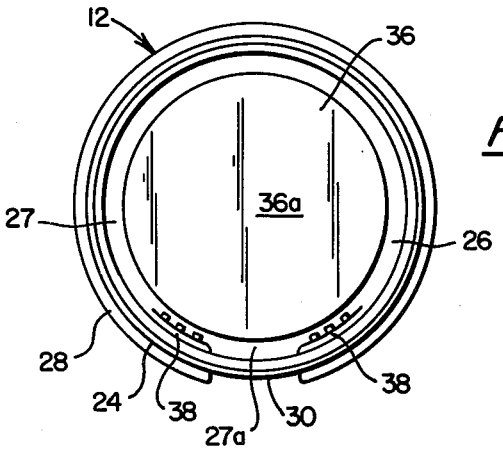
FIG. 4
FIG. 7
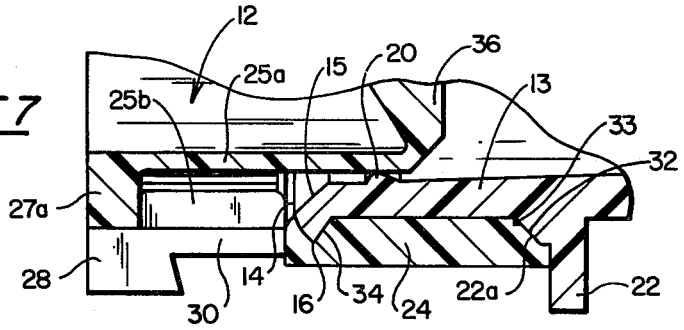

SELF-SEALING DISPENSING VALVE AND SPOUT ASSEMBLY

BACKGROUND OF THE INVENTION

This invention relates to a dispensing valve of the automatically-sealing or self-closing type mounted on a cooperating spout of a flexible bag of a disposable bag-in-box package of the well-known type which is now commonly in use for packaging various liquids.

Various dispensing valves of this general type have been provided in the prior patent art as well as in actual use. One type of valve is illustrated in Fattori U.S. Pat. No. 3,400,866 and a further development thereof is illustrated in Scholle U.S. Pat. No. 3,443,728. Scholle U.S. Pat. No. 4,211,348 discloses a specifically different valve structure and discusses the two previously issued patents numbered above stating that the valves disclosed respectively therein suffer certain disadvantages in terms of sealing effectiveness and pressure capacity because the so-called Fattori valve seals on the lip of the spout which is often nicked or deformed. This Scholle U.S. Pat. No. 4,211,348 discloses a structure intended to overcome these disadvantages but which has other disadvantages.

Another prior art patent which was also discussed in Scholle U.S. Pat. No. 4,211,348 was the patent to Welsh, U.S. Pat. No. 3,972,452, as showing an axially inwardly extending flexible cylindrical wall or skirt which did seal on the interior surface of the spout but which Scholle contended used too much material and did not seal effectively.

The Scholle U.S. Pat. No. 4,211,348 states it overcomes the disadvantages of the prior art by providing a valve in the form of flat-bottom, cylindrical cup-shape flexible member which has a cylindrical wall that fits within the spout and stresses that it has an annular sealing bead on the outer surface thereof for sealing engagement with the spout axially inwardly from the lip thereof, a toggle lever being provided to bend the cylindrical wall and sealing bead radially-inwardly to provide a dispensing outlet between the wall and spout. The main disadvantage of this structure is that the relatively heavy sealing bead on the cylindrical wall must be flexed with the wall each time the valve is opened so that after repeated use it tends to become distorted. Also, the bead stiffens the wall so that more pressure on the toggle lever is required to flex it and flow is difficult to regulate because of the pressure required to hold the lever at various positions.

BRIEF DESCRIPTION OF THE INVENTION

The present invention provides a dispensing valve of resiliently flexible material which fits within the spout of a flexible bag or the like which has one or more annular sealing ribs formed therein at a protected location spaced axially within the lip of the spout. The valve has a flexible annular sealing wall joined to an inner transverse wall which carries an outwardly-projecting toggle lever by means of which a portion of the annular wall can be flexed. Normally, the annular wall resiliently engages the annular sealing rib on the spout, but by actuating the lever, a portion of it can be flexed inwardly away from the rib to provide an outlet passage to a dispensing outlet of the valve outwardly of the rib. The sealing rib on the spout is never bent or distorted and, therefore, will always retain its original annular form so that the annular flexible wall on the valve can always effectively seal thereagainst. This structure also results in an easier opening valve with a better regulated flow, since it is easier to move and control the position of the toggle lever.

BRIEF DESCRIPTION OF THE DRAWINGS

The best mode comtemplated in carrying out this invention is illustrated in the accompanying drawings in which:

FIG. 3 is a perspective view of the spout;

FIG. 4 is a view of the inner end of the valve;

FIG. 7 is an enlarged detail in axial section of the valve and spout taken at the dispensing outlet;

DETAILED DESCRIPTION OF THE INVENTION

Figure 1:
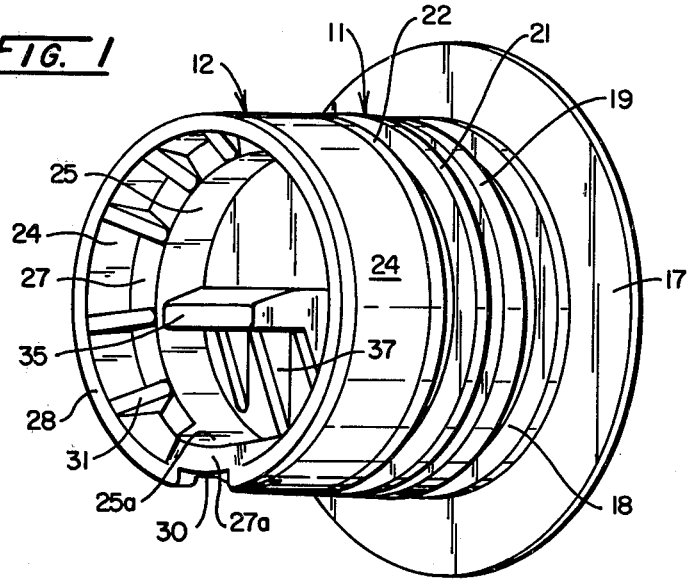
FIG. 1 is a perspective view of the valve and spout assembly of this invention.
Figure 2:
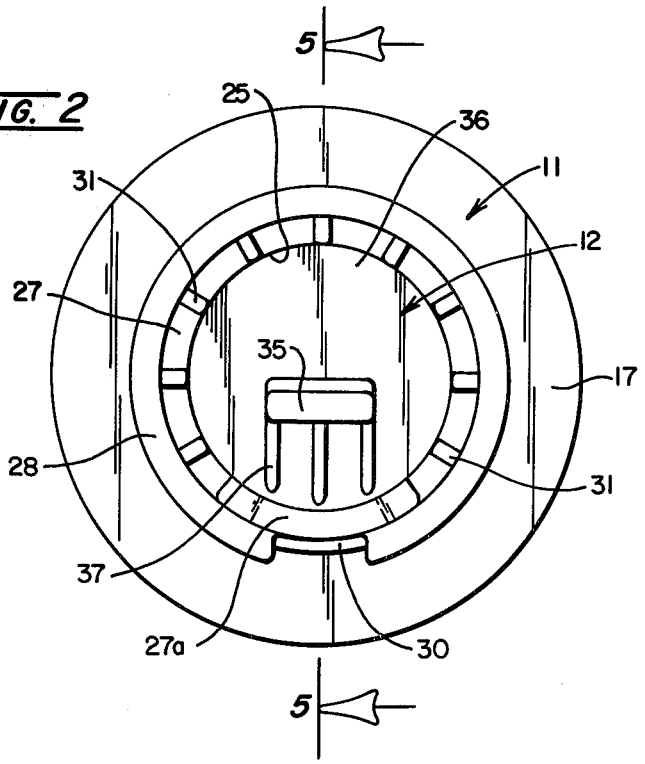
FIG. 2 is an outer end view of the assembly.
Figure 5:
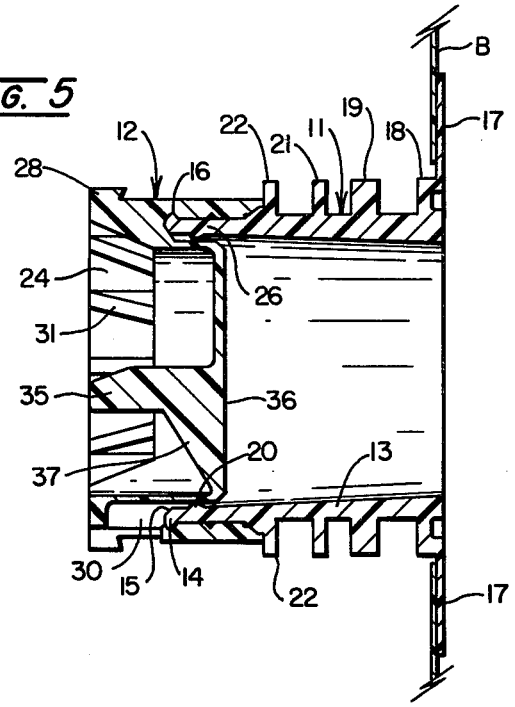
FIG. 5 is an axial sectional view taken along line 5—5 of FIG. 2 showing the valve closed.
Figure 9:
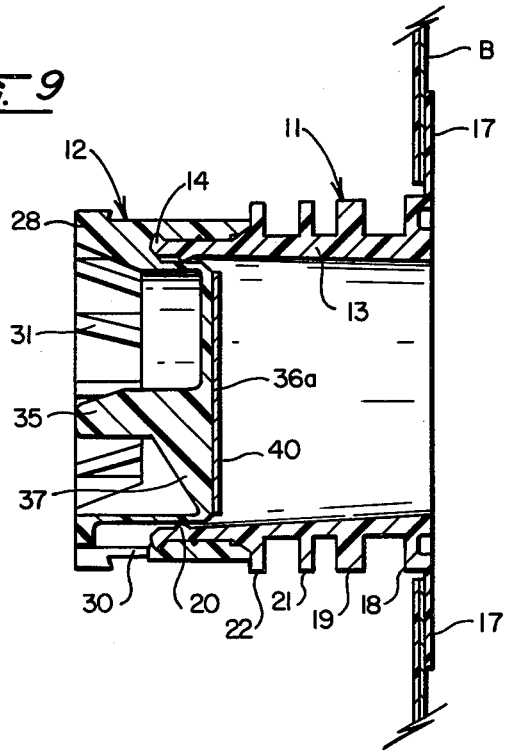
FIG. 9 is an axial sectional view showing the valve provided with gas barrier means.
Figure 11:
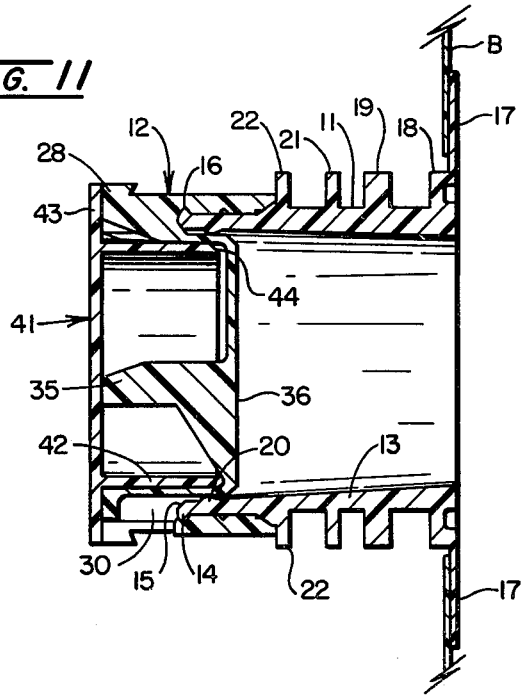
FIG. 11 is an axial sectional view through the assembly of FIG. 10.

With specific reference to the drawings, this invention is shown applied to a flexible plastic bag of the type of package known generally as bag-in-box and illustrated at B in FIGS. 5, 9 and 11. The assembly of this invention comprises a spout indicated generally by the numeral 11 and a valve indicated generally by the numeral 12. The spout is made of the usual semi-rigid plastic material, such as polyethylene. The cap is made of the usual elastomeric or resiliently flexible plastic material, such as a modified EVA copolymer.

The spout 11 (FIG. 3) has a body 13 of annular tubular form which has an inner surface that tapers slightly so that its wall thickness decreases slightly towards its outer lip 14. At the other lip 14, is an inner annular chamfered surface 15 (FIG. 7) on an outer projecting annular locking shoulder or rib 16. At the inner end of the spout body 13, is an annular peripheral relatively flexible attaching continuous annular flange 17 which is used to attach it to the flexible bag B, the material of the flexible bag extending over it or beneath it and being heat-sealed thereto, FIGS. 5, 6, 9 and 11 showing the bag material extending over the flange. Connecting the flange 17 to the body 13, is a continuous annular projecting shoulder section 18 which provides a projecting shoulder directly adjacent the laminate of bag material to prevent contact therewith by equipment which engages with the spout 11 between that shoulder and an axially-outwardly spaced annular flange 19. An additional annular flange 21 may be provided farther out on the spout body and still another outermost annular flange 22 is provided on the spout body but this is spaced axially-inwardly a predetermined distance from the lip 14 to serve as a stop for aiding in positioning the valve 12. An annular shoulder formation **22*a* is associated with flange 22** as shown.

An important sealing element for the valve 11 with the spout 12 is the provision of a continuous annular sealing rib or ribs, shown for example, as a single rib 20 which is formed to the interior surface of the spout body 13 at a definite axial position therealong. This position, as shown, is axially intermediate the outer spout lip 16 and the outermost flange 22 thereon so that it will be in a predetermined axial position relative to the valve 12 when the valve is positioned on the spout and engages with the stop flange 22. The attaching flange 17 will be relatively thin and flexible whereas the remainder of the spout will be heavier, and consequently semi-rigid.

As indicated above, the valve 12 is made of plastic material which is elastomeric or resiliently flexible so that, if after having been distorted under pressure and the pressure is released, it will return to its original shape. The valve comprises two concentric walls 24 and 25 shown in FIGS. 1, 2, and 4 to 11 with an axially-inwardly opening spout-receiving socket 26 provided therebetween.

The larger diameter outer wall 24 is of greater axial extent than the smaller diameter inner wall 25 which is in the form of an annular cylindrical wall extending inwardly from a joining transverse flange 27 which extends radially outwardly therefrom to its connection with the annular wall 24 which is at an axial position intermediate the outer and inner ends of wall 24. The outer end of wall 24 has a reinforcing bead 28 on its periphery. The bead 28 and outer end extremity of the wall are notched to provide a dispensing outlet 30 but it will be noted that this outlet extends only axially inwardly to the transverse position of the flange 27, but the flange does not extend across the outlet. In fact, the inner wall 25 is extended outwardly to provide an extension **25*a* of blunted triangular form that overlaps the outlet 30 and is reinforced by flange 27*a* which, in effect, is a continuation of flange 27 and extends across outlet 30 at its outer edge. The part of the outer wall 24 extending axially-outwardly of the connecting flange 27 is reinforced by triangular gussets 31, at angularly-spaced positions, which extend between those members. The inner edge of wall 24 is flared or tapered at 32 from an annular shoulder 33. The spout is complementally shaped at 22*a* (FIGS. 7 and 8) to receive this flexible edge. Just inwardly of the flange 27, the wall 24 is provided with an annular retaining shoulder 34 for receiving the annular locking shoulder 16 on the spout body 13**.

Figure 6:
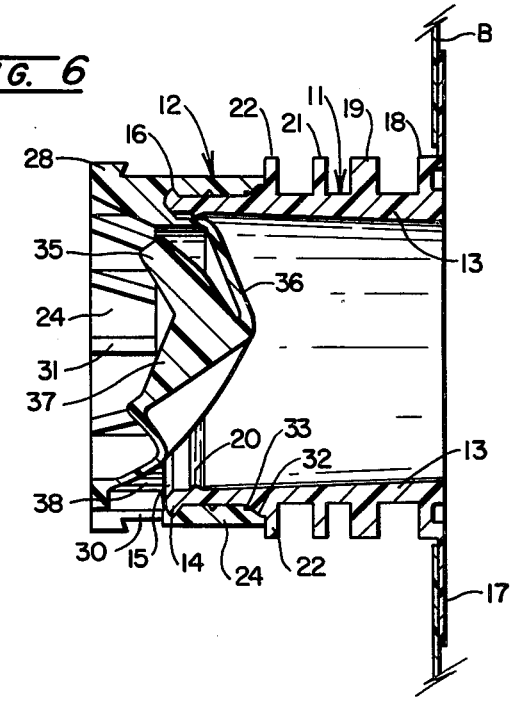
FIG. 6 is a view similar to FIG. 5 showing the valve in opened position.
Figure 8:
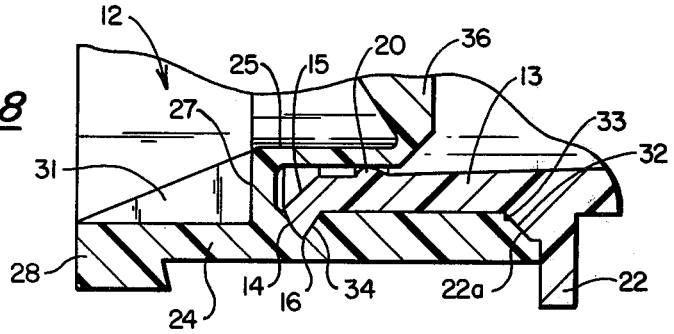
FIG. 8 is a similar axial section taken at an angular position away from the outlet.

As indicated, the inner smaller diameter wall 25 extends axially inwardly from the transverse flange 27 which joins it to the outer wall 24 except at the outlet 30. This inner wall is annular and concentric with the outer wall 24 which is mainly annular except for the notch provided for outlet 30. Furthermore, as indicated these walls provide the axially-inwardly opening spout-receiving socket 26 therebetween which is closed at its outer end by flange 27 except at outlet 30. The inner wall 25 is joined at its inner end throughout its annular extent to a transverse wall 36 which has a flat exposed surface **36*a*. This flat wall is normal to the axis of the annular wall 25 so that the annular wall 25 and the flat wall 36 are connected at a sharp or right angle. Directly opposite the extension 25*a* of inner wall 25, which overlaps outlet notch 30 in outer wall 24, an outwardly-projecting toggle-lever 35 is provided on the transverse wall 36. This lever is of substantial lateral extent so it can be engaged by the thumb and extends substantially along and parallel to the diameter of wall 36 to which it is connected by triangular gussets 37 directed toward extension 25*a*. Radial-inward pressure with the thumb on the lever 35 will flex the material of the extension 25*a* of the inner wall 25 so it will distort inwardly away from the outlet 30. This is due to the fact that because of the gusset connection 37, a radial portion of the transverse wall 36 adjacent thereto is distorted axially outwardly which causes the connected extension 25*a* to distort radially inwardly. Due to the sharp angular connection between the wall 36 and extension 25*a*, the wall members and toggle lever will quickly snap back into position when pressure on the lever is released. Small serrations 38 are provided at each side of outlet notch 30 on the inner surface of wall 24 for the full extent of the notch and are connected to flange 27*a* of extension 25 (FIGS. 4 and 6**).

When the valve 12 is positioned on the spout 11, the lip 14 of the spout is inserted into the socket 26 of the valve. The taper of the inner surface of the body 13 of the spout facilitates entrance of the inner annular valve wall 25, whereas taper 32 on the edge of outer valve wall 24 permits it to readily slip over shoulder 16 on the lip of the spout. Axial inward movement of the valve onto the spout will be completed by interengaging elements therebetween when the valve edge 32 reaches spout flange 22 and the spout locking shoulder 16 snaps behind valve shoulder 34. The inner wall 25 will be of sufficient axial extent that, at this time, the transverse wall 36 carried thereby will be located inwardly well beyond the annular sealing rib 20 on the spout. The wall 36 is cylindrical and is of an outer diameter slightly less than the inner diameter of the spout body at the rib. Consequently, there will be a tight frictional seal at the rib inwardly of the spout lip. To open the valve, as indicated, pressure is applied to the toggle lever 35, which flexes transverse wall 36 and wall 25 and its extension **25*a* adjacent outlet 30, as shown in FIG. 6, to form a passage between the spout wall and wall 25 and beyond the spout lip 14 to that outlet. This passage will include a tapering section 25*b* in extension 25*a* (FIG. 7). The major part of the inner sealing wall 25 will not flex because it is connected to the flange 27 but will flex only at the extension 25*a* opposite outlet 30. Serrations 38 prevent most of any liquid which enters the passage section 26*b* at the sides of outlet notch 30 when the valve is dispensing from dripping from that section when the valve snaps closed. A capillary attraction action is set up at the serrations which tends to retain any liquid is passage section 25*b* of extension 25*a*. As soon as pressure on the lever 35 is released, the wall extension 25*a* and associated sealing wall 25 and transverse wall 36 will return to their original condition shown in FIG. 5, to restore the seal at annular spout rib 20 which is axially inwardly of outlet 30. Reinforcing of the outwardly-projecting portion of the wall by the gussets 31 will maintain the annular shape of this wall portion during actuation of the valve. The axial outward extension of this wall portion is necessary to provide room for the outlet notch 30 in the outer wall 24 beyond spout lip 14 and to provide for the tapering section 25*b*** of the dispensing passage which is kept as small as possible to minimize accumulation of product after valve closing.

The reinforcement to keep the outward extension of wall 24 annular is important because distortion thereof during operation of the valve or at any time would cause displacement of the valve sealing means and consequent leakage.

In FIG. 9, the valve 12 is shown with its flat wall surface 36*a* covered with a disc or coating 40 of gas barrier material of any of the various types now commonly in use such as polysaran. The bag material will be a laminate B including at least one of the common barrier materials. This barrier 40 will reduce penetration of oxygen through the closed valve.

Figure 10:
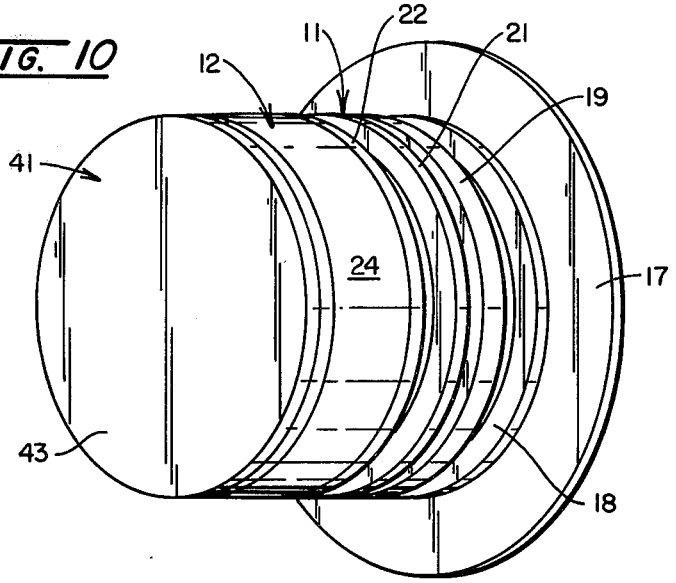
FIG. 10 is a perspective view of the assembly showing the valve with a seal retainer positioned therein.

For shipping, handling or to increase shelf life, it may be desirable to provide the valve member of a filled bag with a seal retainer 41, as shown in FIGS. 10 and 11, which will maintain the valve closed and sealed until removed. This insert is shown in the form of an inwardly extending tapering skirt or sleeve body 42 which has a chamfered inner edge 44. The sleeve body is carried by an outer cap disc 43. The outer diameter of the tapering sleeve body 42 is such that it can be inserted in the valve member 12 within the inner wall 25 and it will wedge or fit tightly therewithin as it is moved axially inwardly until the projecting edge of disc 43 contacts the outer rib 28 on the outer wall 24. At this time, the inner edge of the sleeve will not yet contact transverse wall 36. The sleeve will be within reinforcing members 31 and will surround toggle lever 35 which will be covered by cap disc 43. As long as retainer 41 is in position, it will keep the inner sealing wall 25 of the valve in contact with the sealing rib 20 of the spout 11 and lever 35 covered so it cannot be engaged. However, it can be withdrawn readily by engagement of a member between rib 28 and the edge of disc 43 to pry it axially outwardly so that thereafter, the valve member can be operated by the toggle lever 35. Thus, the seal retainer 41 provides a plug body 42 with an annular outer peripheral surface extending axially-inwardly beyond sealing rib 20 and which engages the sealing wall 25 of the valve member 12 to hold it outwardly in sealing relationship with the spout. The sleeve-like body also provides a socket for receiving the toggle lever 35 as the retainer is inserted in the valve member. In addition, the body 42 provides an outer cover or closure 43 which closes the socket to reduce penetration of oxygen into the bag B when the seal retainer is in place in the valve member.

It will be apparent that this invention provides a removeable and replaceable self-sealing valve formed of resiliently flexible plastic which has inner and outer concentric walls spaced to provide an axially inwardly-opening socket for receiving the outer end of a semi-rigid plastic spout carried by a flexible plastic bag. The spout has one or more inner anular sealing ribs formed therein at a location spaced axially-inwardly from its lip and the inner wall normally resiliently engages this seal. However, means is connected to the inner wall to flex it so that a portion thereof is flexed away from the sealing rib or ribs to open a dispensing passage to an outlet in the outer wall beyond the spout lip.

Having thus described the invention what is claimed is:

1. A dispensing valve and spout assembly comprising: an annular spout having an outer end lip; a valve member formed of resiliently flexible material and comprising inner and outer concentric walls which are joined at their outer portions but spaced apart to provide an axially opening socket for receiving the spout so that the inner wall sealingly engages the spout inwardly of its lip and the outer wall extends outwardly beyond the spout lip where an outlet opening is provided therein, said inner wall having a transverse wall connected thereto at its inner end, means on said transverse wall for flexing it and said inner wall to move it away from sealing engagement with said spout to provide a dispensing passage between said inner wall and spout to said outlet in said outer wall, and a removable sleeve insert positioned within said inner wall to hold it in sealing position with said spout; said flexing means being a lever projecting outwardly from said transverse wall, said sleeve insert surrounding said lever; said sleeve being carried by an outer disc which covers the lever and extends over the outer end of the outer wall.

2. An assembly according to claim 1 in which the sleeve is tapered to fit frictionally within the inner wall.

3. An assembly according to claim 1 in which the inner wall and outer wall are connected together by a transverse flange at the outer end of the inner wall and intermediate the outer wall, said outer wall being reinforced by angularly spaced gussets extending between it and said flange.

4. A dispensing valve and spout assembly comprising: an annular spout having an outer end lip; a valve member formed of resiliently flexible material and comprising inner and outer concentric walls which are joined at their outer portions but spaced apart to provide an axially inwardly-opening socket for receiving the spout so that the inner wall sealingly engages the spout axially inwardly of its lip and the outer wall extends axially outwardly beyond the spout lip where an outlet opening is provided therein, said inner wall having a transverse wall connected thereto at its inner end, axially-outwardly projecting means on said transverse wall for flexing it and said inner wall to move it away from sealing engagement with the spout to provide a dispensing passage between said inner wall and spout to said outlet in said outer wall; and a removable seal retainer insert positioned within said inner wall and having a body with an annular peripheral surface engaging said inner wall to hold it in sealing engagement with said spout and an axially-inwardly opening socket for receiving said axially-outwardly projecting means on said transverse wall.

5. A dispensing valve and spout assembly according to claim 4 in which said projecting means is a toggle lever, said seal retainer body also having an outer closure portion which closes the axially outer end of the socket.

6. A dispensing valve and spout assembly according to claim 5 in which the closure portion is provided by a cover disc on the retainer body which extends radially over the joined outer ends of said concentric inner and outer wall.

7. A dispensing valve according to claim 4 in which said spout has an annular sealing rib axially-inwardly of its lip and said peripheral surface of the retainer extending axially-inwardly beyond the lip.

8. A dispensing valve according to claim 1 in which said spout has an annular sealing rib axially-inwardly of its lip and said sleeve extends axially-inwardly beyond the lip.

* * * * *